US011339453B2

(12) United States Patent
Kim

(10) Patent No.: US 11,339,453 B2
(45) Date of Patent: May 24, 2022

(54) APPARATUS FOR HEATING STEEL SHEET

(71) Applicants: Hyundai Motor Company, Seoul (KR); Kia Motors Corporation, Seoul (KR)

(72) Inventor: Young Tae Kim, Gunpo-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 154 days.

(21) Appl. No.: 16/811,157

(22) Filed: Mar. 6, 2020

(65) Prior Publication Data

US 2020/0392597 A1 Dec. 17, 2020

(30) Foreign Application Priority Data

Jun. 17, 2019 (KR) ..... 10-2019-0071715

(51) Int. Cl.
*C21D 9/46* (2006.01)
*C21D 1/40* (2006.01)

(52) U.S. Cl.
CPC ..... *C21D 9/46* (2013.01); *C21D 1/40* (2013.01)

(58) Field of Classification Search
CPC ..... C12D 9/46; C12D 1/40
See application file for complete search history.

(56) References Cited

U.S. PATENT DOCUMENTS

2011/0303328 A1* 12/2011 Kondo ..... C21D 1/673 148/533
2015/0282253 A1* 10/2015 Lackman ..... H05B 3/023 219/158
2020/0367321 A1* 11/2020 Ooyama ..... H05B 3/02
2020/0392597 A1* 12/2020 Kim ..... C21D 9/46

* cited by examiner

*Primary Examiner* — Scott R Kastler
(74) *Attorney, Agent, or Firm* — Slater Matsil, LLP

(57) ABSTRACT

An apparatus can be used for heating a steel sheet. A positive electrode is configured to make contact with a first electrode area of the steel sheet and a negative electrode is configured to make contact with a second electrode area of the steel sheet. A cooling member includes a cooling block configured to make contact with a cooling area adjacent to a third edge parallel to a second direction. The cooling member is configured to radiate heat generated from the steel sheet. The positive electrode, the negative electrode, and the cooling member are arranged on the steel sheet such that the resistance of a path from the positive electrode to the negative electrode through an area with which the cooling member makes contact is higher than the resistance of a path from the positive electrode to the negative electrode through the cooling member.

19 Claims, 7 Drawing Sheets

APPARATUS FOR HEATING STEEL SHEET

CROSS-REFERENCE TO RELATED APPLICATIONS

This application claims priority to Korean Patent Application No. 10-2019-0071715, filed in the Korean Intellectual Property Office on Jun. 17, 2019, which application is hereby incorporated herein by reference.

TECHNICAL FIELD

The present disclosure relates to an apparatus for heating a steel sheet.

BACKGROUND

A steel sheet used for various types of doors and frames of a vehicle body may be processed into a part of the vehicle body by heating a steel sheet blank that is a base material, transferring, pressing, and cooling the steel sheet blank, extracting a part, and trimming the part with a laser.

Various methods are used to heat the steel sheet blank. The steel sheet blank may be heated by a method using a heat source such as a laser, a method of maintaining a mold in contact with a desired portion at high temperature, a method of selectively heating only a specific portion in a gas furnace or an electric furnace, and the like. Furthermore, the steel sheet blank may be heated by using heat according to the resistance of the steel sheet blank by applying electricity to the steel sheet blank.

However, in the case of applying electricity to the steel sheet blank, heat may be concentrated around electrodes, and the central area of the steel sheet blank may not be heated. Therefore, unwanted melting of the material around the electrodes may occur. Furthermore, the central area may not be heated as much as required and therefore additional processing may be required.

SUMMARY

Embodiments of the invention can solve above-mentioned problems occurring in the prior art while advantages achieved by the prior art are maintained intact.

An aspect of the present disclosure provides a steel sheet heating apparatus for freely heating a desired portion of a steel sheet while passing an electric current through the steel sheet, and preventing concentration of heat around a cooling member.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an apparatus for heating a steel sheet includes a positive electrode and a negative electrode that make contact with electrode areas, respectively, which are two areas adjacent to two respective edges parallel to a first direction among edges of the steel sheet and a cooling member including a cooling block that makes contact with a cooling area adjacent to an edge parallel to a second direction perpendicular to the first direction, among the edges of the steel sheet, to radiate heat generated from the steel sheet. The heat is generated from the steel sheet by allowing an electric current to flow from the positive electrode to the negative electrode through the steel sheet. The positive electrode, the negative electrode, and the cooling member are arranged on the steel sheet such that resistance of a path from the positive electrode to the negative electrode through an area with which the cooling member makes contact is higher than resistance of a path from the positive electrode to the negative electrode through the cooling member.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF ILLUSTRATIVE EMBODIMENTS

Figure 1:
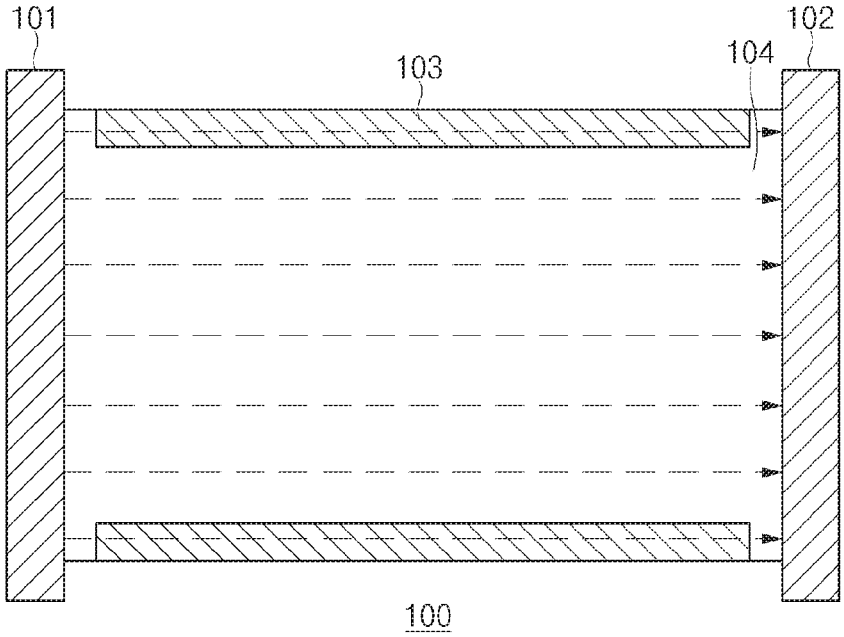
FIG. 1 is a plan view of an exemplary steel sheet heating apparatus.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the components. When a component is described as "connected", "coupled", or "linked" to another component, they may mean the components are not only directly "connected", "coupled", or "linked" but also are indirectly "connected", "coupled", or "linked" via a third component.

FIG. 1 is a plan view of an exemplary steel sheet heating apparatus 1.

Referring to FIG. 1, the exemplary steel sheet heating apparatus 100 includes electrodes 101 and 102 and cooling blocks 103 that make contact with a steel sheet 104. An electric current flows from the positive electrode 101 to the negative electrode 102 through the steel sheet 104. Heat is generated in the steel sheet 104 by the electric current flowing through the steel sheet 104. The cooling blocks 103 cool the heat generated in the steel sheet 104. Accordingly, the resistance of the steel sheet 104 in the areas covered by the cooling blocks 103 is lower than the resistance of the steel sheet 104 in the area not covered by the cooling blocks 103. In a circuit including resistors connected in parallel, a larger amount of electric current flows through a resistor having a lower resistance value. Accordingly, the amount of electric current flowing through the areas of the steel sheet 104 that are covered by the cooling blocks 103 is larger than the amount of electric current flowing through the area of the steel sheet 104 that is not covered by the cooling blocks 103. Because a larger amount of electric current flows through the areas covered by the cooling blocks 103, a larger amount of heat is generated in the areas covered by the cooling blocks 103, and the heat is concentrated around the cooling blocks 103.

Figure 2:
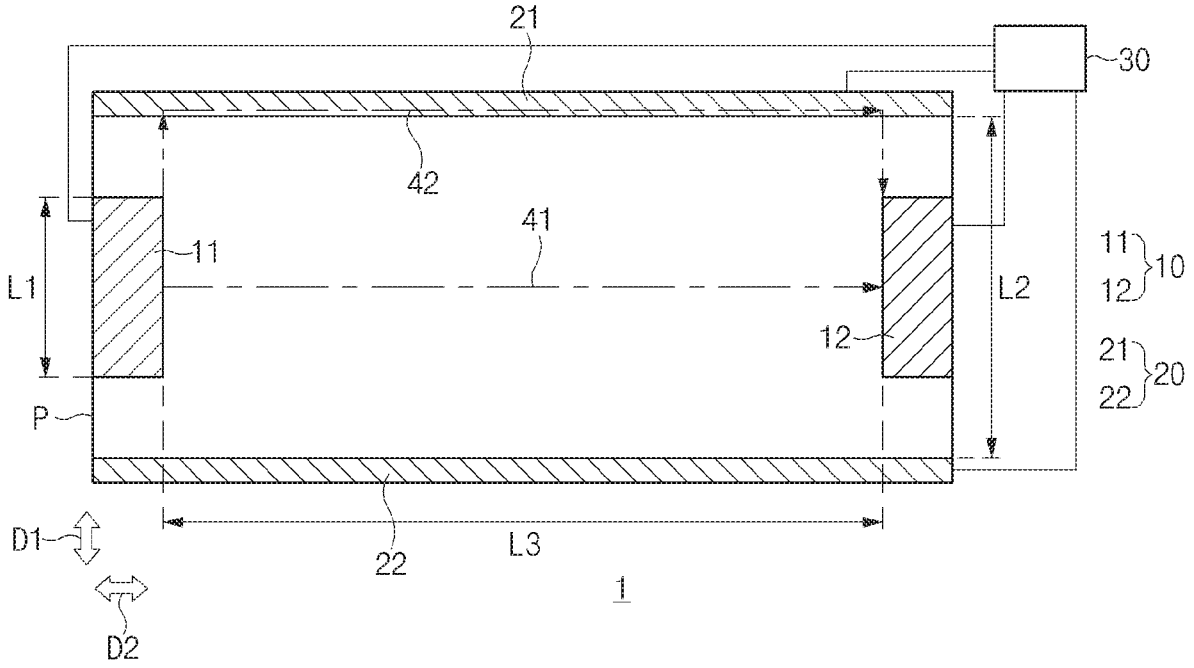
FIG. 2 is a plan view of a steel sheet heating apparatus according to an embodiment of the present disclosure.

FIG. 2 is a plan view of a steel sheet heating apparatus 1 according to an embodiment of the present disclosure.

Referring to FIG. 2, the steel sheet heating apparatus 1 according to the embodiment of the present disclosure may include electrodes 10 and a cooling member and may further include a controller 30.

The electrodes 10 are components for allowing an electric current to flow through a steel sheet P. The electrodes 10 may be constituted by a total of two electrodes, including a positive electrode 11 and a negative electrode 12 and may make contact with the steel sheet P.

An electric current may flow from the positive electrode 11 to the negative electrode 12 through the steel sheet P, and therefore the steel sheet P may generate heat. The steel sheet P may have a rectangular parallelepiped shape. In the embodiment of the present disclosure, it is assumed that the steel sheet P has a rectangular parallelepiped shape. However, the steel sheet P may be formed in a different three-dimensional shape.

The electrodes 10 may be electrically connected to the controller 30 that will be described below, and may receive electric power from the controller 30. The electrodes 10 receive the electric power, and the electric current flows through the steel sheet P located between the positive electrode 11 and the negative electrode 12. That is, the controller 30, the electrodes 10, and the steel sheet P may form a closed circuit to allow the electric current to flow.

The electrodes 10 may make contact with electrode areas, respectively, which are two areas adjacent to two respective edges (P1 of FIG. 4) that are parallel to a first direction D1 among the edges of the steel sheet P. The first direction D1 refers to the vertical direction in FIG. 2, and a second direction D2 that will be described below refers to the horizontal direction in FIG. 2. However, the first direction D1 and the second direction D2 are not limited thereto. The two edges (P1 of FIG. 4), which are located at opposite ends of the steel sheet P with respect to the second direction D2, may be formed parallel to the first direction D1. The two electrode areas may be formed adjacent to the two edges (P1 of FIG. 4), and the two electrodes 10 may be disposed on the two electrode areas, respectively. The electrodes 10 may be located at the centers of the two edges with respect to the first direction D1.

The electrodes 10 may have a shape that extends in the first direction D1 such that the width L1 in the first direction D1 is greater than the width in the second direction D2. However, the width L1 of the electrodes 10 in the first direction D1 may be smaller than the width of the steel sheet P in the first direction D1. Accordingly, the width L1 of the electrodes 10 in the first direction D1 may be smaller than the length of the two edges (P1 of FIG. 4) that are parallel to the first direction D1 among the edges of the steel sheet P. Furthermore, the electrodes 10 may be disposed at the centers of the two edges and may not make contact with opposite ends of the steel sheet P in the first direction D1. In addition, the electrodes 10 may be arranged along the edges (P1 of FIG. 4) of the steel sheet P that are parallel to the first direction D1.

The positive electrode 11 and the negative electrode 12 may be disposed on the steel sheet P such that the separation distance L3 between the positive electrode 11 and the negative electrode 12 with respect to the second direction D2 is constant. The positive electrode 11 and the negative electrode 12 may be disposed on the steel sheet P so as to have line symmetry with respect to a straight line passing through the center of the steel sheet P along the first direction D1.

The electrodes 10 may be formed of a material containing copper (Cu). However, the material of the electrodes 10 is not limited thereto.

The cooling member is a component for cooling the heated steel sheet P. The cooling member includes cooling blocks 20 that make contact with the steel sheet P, receive heat from the steel sheet P, and radiate the received heat. The cooling blocks 20 make contact with cooling areas (A2 of FIG. 3), respectively, which are adjacent to edges (P2 of FIG. 4) that are parallel to the second direction D2 among the edges of the steel sheet P, to radiate heat generated from the steel sheet P. The cooling areas A2 are partial areas of the steel sheet P with which the cooling blocks 20 make contact. The cooling areas A2 are disposed adjacent to the edges P2 of the steel sheet P that are parallel to the second direction D2.

The cooling member may include a plurality of cooling blocks 20. In the embodiment of the present disclosure, two cooling blocks 20 are used. However, the number of cooling blocks 20 is not limited thereto. The two cooling blocks 20 may be disposed adjacent to the opposite ends of the steel sheet P with respect to the first direction D1, respectively.

The two cooling blocks 20 may be disposed such that the separation distance L2 between the two cooling blocks 20 that face each other with respect to the first direction D1 remains constant along the second direction D2. The two cooling blocks 20 may be disposed on the steel sheet P so as to have line symmetry with respect to a straight line passing through the center of the steel sheet P along the second direction D2. In FIG. 2, a first cooling block 21 is illustrated as being disposed on an upper side of the drawing, and a second cooling block 22 is illustrated as being disposed on a lower side of the drawing.

The cooling blocks 20 may have a shape that extends in the second direction D2 such that the width in the second direction D2 is greater than the width in the first direction D1. Accordingly, the cooling blocks 20 may be arranged along the edges (P2 of FIG. 4) of the steel sheet P that are parallel to the second direction D2 and may make contact with the steel sheet P.

The cooling blocks 20 may radiate, into the air through surfaces that do not make contact with the steel sheet P, heat transferred from the steel sheet P. To more efficiently radiate the heat, a heat dissipation structure (not illustrated), such as fins, may be formed on side surfaces of the cooling blocks 20 that do not make contact with the steel sheet P. In addition, the cooling member may further include an airconditioning device (not illustrated) to form a flow of refrigerant, such as air, around the heat dissipation structure, thereby enabling the cooling blocks 20 to be more efficiently cooled.

Figure 3:
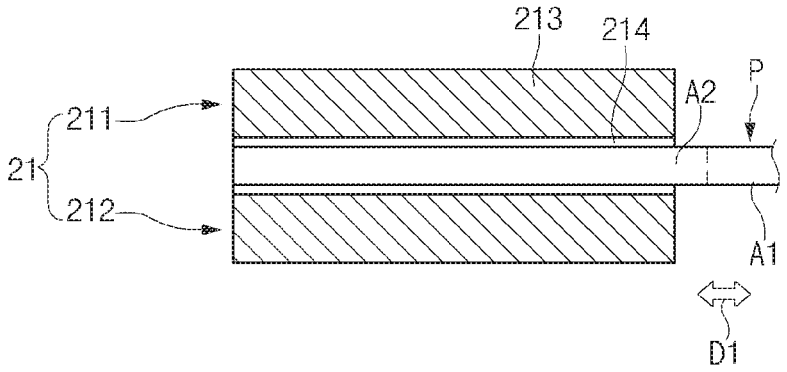
FIG. 3 is a side view illustrating a situation in which a cooling block of the steel sheet heating apparatus according to the embodiment of the present disclosure is brought into contact with a steel sheet.

FIG. 3 is a side view illustrating a situation in which the cooling block 20 of the steel sheet heating apparatus 1 according to the embodiment of the present disclosure is brought into contact with the steel sheet P.

The cooling block 20 may be divided into two sub-blocks 211 and 212. FIG. 3 illustrates an area adjacent to the first cooling block 21, which is the cooling block 20 disposed on the upper side of FIG. 2 among the cooling blocks 20. The first cooling block 21 may include sub-block 1-1 211 and sub-block 1-2 212 as the sub-blocks 211 and 212.

Coating layers 214 may be formed on contact side surfaces that make contact with the cooling area A2 among the side surfaces of the cooling block 20 and may electrically insulate the cooling block 20 from the steel sheet P. In the drawing, the coating layers 214 are formed on a lower surface of a block body 213 of sub-block 1-1211 and on an upper surface of a block body 213 of sub-block 1-2 212.

The block bodies 213 of the cooling block 20 may be formed of a material having a higher thermal conductivity than iron. For example, the block bodies 213 may be formed of an alloy containing aluminum or copper with conductivity, and the coating layers 214 may be formed of a ceramic material and may electrically insulate the cooling block 20 from the steel sheet P. The coating layers 214 may have a thickness ranging from 0.1 mm to 1 mm.

The cooling block 20 may make contact with the upper or lower surface of the cooling area A2, or may be formed to make contact with both the upper and lower surfaces of the cooling area A2. As illustrated, the cooling block 20 may have the two sub-blocks 211 and 212, and the two sub-blocks 211 and 212 may make contact with the upper and lower surfaces of the cooling area A2, respectively. However, the cooling block 20 may be formed to surround the cooling area A2 and may make contact with both the upper and lower surfaces of the cooling area A2.

The arrangement of the electrodes 10 and the cooling member on the steel sheet P will be described with reference to FIG. 2. In a state in which the temperature of the steel sheet P is uniform, the electrodes 10 and the cooling blocks 20 of the cooling member may be arranged on the steel sheet P such that the resistance of a cooling area path 42 from the positive electrode 11 to the negative electrode 12 through the area with which the cooling member makes contact is higher than the resistance of a heating area path 41 from the positive electrode 11 to the negative electrode 12 through the cooling member. Accordingly, when an electric current is supplied to the steel sheet P through the electrodes 10 in the state in which the temperature of the steel sheet P is uniform, the magnitude of an electric current flowing along the heating area path 41 may be greater than the magnitude of an electric current flowing along the cooling area path 42.

The electrodes 10 and the cooling member may be arranged as follows such that the heating area path 41 and the cooling area path 42 have resistance values with the above-described magnitude relationship. The electrodes 10 and the cooling member may be arranged such that distal ends of the electrodes 10 that are adjacent to the cooling member with respect to the first direction D1 are spaced apart from the cooling member along the first direction D1. Accordingly, a line segment representing a minimum distance from the positive electrode 11 to the negative electrode 12 may not pass through the cooling member.

Furthermore, the electrodes 10 and the cooling member may be arranged as follows such that the heating area path 41 and the cooling area path 42 have resistance values with the above-described magnitude relationship. The shortest distance L3 between the positive electrode 11 and the negative electrode 12 may be formed to be smaller than the value obtained by adding the sum L2–L1 of the shortest distance between the cooling member and the positive electrode 11 and the shortest distance between the cooling member and the negative electrode 12 to the distance L3 from the point of the cooling member that is closest to the positive electrode 11 to the point of the cooling member that is closest to the negative electrode 12. That is, the electrodes 10 and the cooling blocks 20 may be arranged such that the length of the cooling area path 42 is longer than the length of the heating area path 41. This is because the magnitudes of resistances of the paths are proportional to the lengths of the paths in a state in which the temperature of the steel sheet P is uniform, when the steel sheet P is formed of a uniform material.

When a predetermined electric current is applied to the steel sheet P through the electrodes 10, a heating area A1 that is the remaining area other than the cooling areas A2 and the electrode areas may be heated to a temperature above the Ac3 point among the transformation points so as to be transformed to martensite after quenching. Furthermore, the electrodes 10 and the cooling member may be arranged such that the cooling areas A2 are elevated to a temperature of 100° C. or less to prevent degradation of material properties.

Because the electrodes 10 are arranged on the steel sheet P as in the steel sheet heating apparatus 1 according to the embodiment of the present disclosure, the steel sheet heating apparatus 1 may relatively reduce the degree to which heat is concentrated around the cooling blocks 20, compared with the exemplary steel sheet heating apparatus 1 of FIG. 1.

The controller 30 may be a component that includes an element capable of a logic operation of performing control commands. The controller 30 may include a central processing unit (CPU). The controller 30 may be connected to the electrodes 10 and the cooling member. The controller 30 may transfer signals according to control commands to respective components. The controller 30 may be connected to various sensors or acquisition devices and may receive obtained information in a signal form. The controller 30 may be electrically connected with the components. The controller 30 may be wiredly connected with the components, or may further include a communication module capable of wireless communication to communicate with the components.

Control commands that the controller 30 performs may be stored and utilized on a storage medium, and the storage medium may be, but is not limited to, a device such as a hard disk drive (HDD), a solid state drive (SSD), a server, a volatile medium, a nonvolatile medium, or the like. In addition, data required for the controller 30 to perform tasks may be additionally stored in the storage medium.

The controller 30 may be electrically connected to the electrodes 10 and may allow an electric current to flow through the electrodes 10. The controller 30 may allow the electric current to flow through the electrodes 10 according to a target heating rate. For this operation, the controller 30 may include a three-phase power supply, an inverter power current control converter that converts a low-frequency current to a direct current and thereafter converts the direct current to a high-frequency current, and a transformer that amplifies the high-frequency current of the inverter depending on a turn ratio. The inverter power current control converter may include an insulated gate bipolar transistor (IGBT).

Furthermore, the controller 30 may include an electrode-moving device (not illustrated) that moves the positions of the electrodes 10 and a block-moving device (not illustrated) that moves the positions of the cooling blocks 20. The electrode-moving device receives a signal from the controller 30, moves the positions of the electrodes 10, and allows the electrodes 10 to be brought into contact with, or separated from, the electrode areas of the steel sheet P. The block-moving device receives a signal from the controller 30, moves the positions of the cooling blocks 20, and allows the cooling blocks 20 to be brought into contact with, or separated from, the cooling areas A2 of the steel sheet P.

Furthermore, the electrode-moving device and the block-moving device may move the positions of the electrodes 10 and the cooling blocks 20 to locate the electrodes 10 and the cooling blocks 20 on the steel sheet P to correspond to the arrangement relationship of the electrodes 10 and the cooling blocks 20. To enable this operation, the electrode-moving device and the block-moving device may be robot arms that are connected to the electrodes 10 and the cooling blocks 20 and that are movable in various directions. However, any devices capable of gripping and moving the electrodes 10 or the cooling blocks 20 may be used as the electrode-moving device and the block-moving device.

Figure 4:
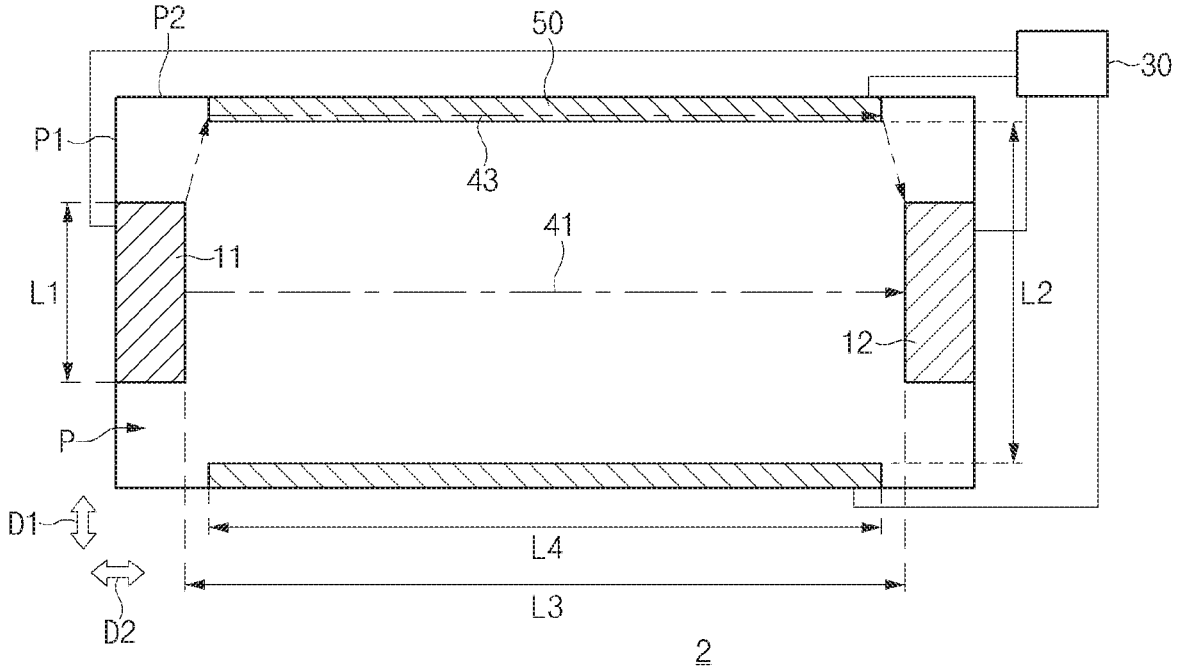
FIG. 4 is a plan view of a steel sheet heating apparatus according to a modified example of the embodiment of the present disclosure.

FIG. 4 is a plan view of a steel sheet heating apparatus 2 according to a modified example of the embodiment of the present disclosure.

The shortest distance L3 between the positive electrode 11 and the negative electrode 12 may be formed to be smaller than the sum of the shortest distance between the cooling member and the positive electrode 11, the shortest distance between the cooling member and the negative electrode 12, and the distance L4 from the point of the cooling member that is closest to the positive electrode 11 to the point of the cooling member that is closest to the negative electrode 12. That is, even in the modified example of the embodiment of the present disclosure, the electrodes 10 and the cooling member may be arranged such that the length of a cooling area path 43 is longer than the length of the heating area path 41.

Even in the modified example of the embodiment of the present disclosure, the electrodes 10 may be disposed at the centers of the edges P1 of the steel sheet P that are parallel to the first direction D1. Furthermore, cooling blocks 50 may be disposed at the centers of the edges P2 of the steel sheet P that are parallel to the second direction D2.

In the modified example of the embodiment of the present disclosure, the lengths of the cooling blocks 50 may be shorter than the lengths of the cooling blocks 20 in the embodiment. Accordingly, the straight lines that connect the points of the electrodes 10 that are closest to the cooling blocks 50 and the points of the cooling blocks 50 that are closest to the electrodes 10 may be formed not to be parallel to the first direction D1 and the second direction D2. In other words, the shortest straight lines that connect the electrodes 10 and the cooling blocks 50 may be formed to be inclined with respect to the first direction D1 and the second direction D2. Accordingly, in FIG. 4, the shortest line segments that connect the electrodes 10 and the cooling blocks 50 may be formed in diagonal directions on the drawing. Due to the reduction in the lengths of the cooling blocks 50, the distances from the electrodes 10 to the cooling blocks 50 account for a high percentage of the entire cooling area path 43. Accordingly, the resistance of the cooling area path 43 may be higher than the resistance of the cooling area path 42 in the embodiment.

Hereinafter, a process in which the steel sheet P is heated and the path of an electric current is changed by allowing the electric current to flow to the steel sheet P through the electrodes 10 will be described with reference to FIGS. 5 to 7. Furthermore, effects of the embodiment of the present disclosure and the steel sheet heating apparatus 2 according to the modified example of the embodiment will be described.

Figure 5:
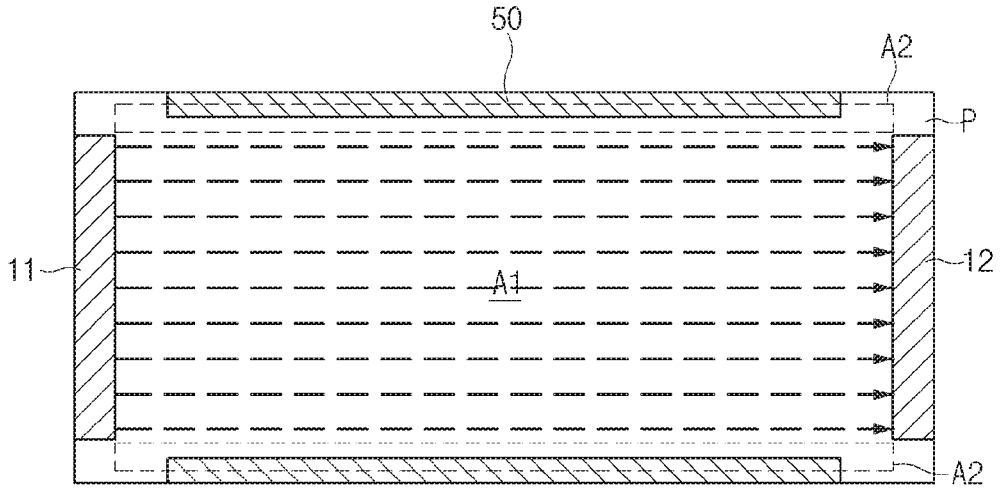
FIG. 5 is a view illustrating a current direction when an electric current starts to flow through electrodes, in the modified example of the embodiment of the present disclosure.

FIG. 5 is a view illustrating a current direction when an electric current starts to flow through the electrodes 10, in the modified example of the embodiment of the present disclosure.

The steel sheet P may have a uniform temperature before the electric current flows through the steel sheet P. Accordingly, the resistances of all the shortest paths that connect the positive electrode 11 and the negative electrode 12 are the same. In contrast, the cooling area path has a higher resistance value because the cooling area path is not the shortest path that connects the positive electrode 11 and the negative electrode 12. Accordingly, the resistance value of the heating area path is lower than the resistance value of the cooling area path, and therefore the current value flowing along the heating area path is higher than the current value flowing along the cooling area path. Thus, the amount of heat generated from the heating area A1 is larger than the amount of heat generated from the cooling areas A2, and the temperature of the heating area A1 is higher than the temperatures of the cooling areas A2.

In the drawing, the cooling areas A2 are illustrated as not making contact with the adjacent edges of the steel sheet P. However, this is only for easy representation of the cooling areas A2 in the drawing, and the cooling areas A2 may reach the adjacent edges of the steel sheet P.

Figure 6:
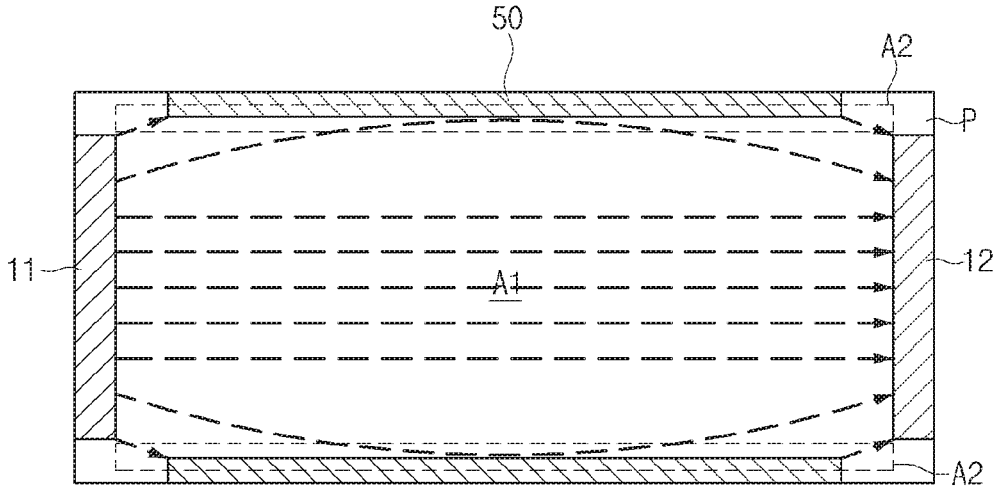
FIG. 6 is a view illustrating a situation in which a current direction bends toward cooling blocks while temperature is raised by allowing an electric current to flow through the electrodes, in the modified example of the embodiment of the present disclosure.

FIG. 6 is a view illustrating a situation in which a current direction bends toward the cooling blocks 50 while temperature is raised by allowing an electric current to flow through the electrodes 10, in the modified example of the embodiment of the present disclosure.

As described above with reference to FIG. 5, temperature more rapidly rises in the heating area A1 than in the cooling areas A2. In the cooling areas A2, cooling is performed by the cooling blocks 50, and a temperature rise is suppressed. Accordingly, the specific resistance of the heating area A1 is higher than the specific resistances of the cooling areas A2, and the difference in resistance between the heating area path and the cooling area path is gradually decreased. Eventually, the resistance of the cooling area path becomes lower than the resistance of the heating area path. Thus, as illustrated in FIG. 6, the amount of electric current flowing along the cooling area path is increased.

Figure 7:
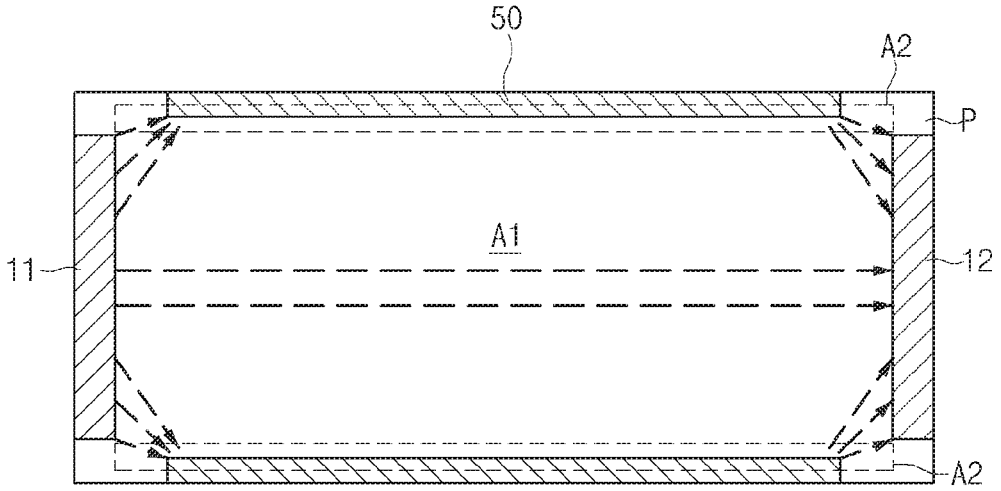
FIG. 7 is a view illustrating a current direction after temperature is sufficiently raised by allowing an electric current to flow through the electrodes, in the modified example of the embodiment of the present disclosure.

FIG. 7 is a view illustrating a current direction after temperature is sufficiently raised by allowing an electric current to flow through the electrodes 10, in the modified example of the embodiment of the present disclosure.

In the case of the heating area A1, an electric current is continuously applied in the state in which the cooling blocks 50 do not make contact with the heating area A1. Therefore, the temperature is consistently raised, and the specific resistance is very high. Accordingly, the resistance of the cooling area path is lower than the resistance of the heating area path, and most of the electric current flows along the cooling area path. Because most of the electric current flows toward the cooling areas, the temperatures of the cooling areas are raised, and the cooling areas start to be heated.

Meanwhile, even when the embodiment of the present disclosure and the modified example thereof are used, the electric current is finally concentrated around the cooling areas. However, the electric current is concentrated around the cooling areas A2 after the electric current sufficiently flows through the heating area A1 and the heating area A1 is heated. Accordingly, the entire steel sheet P may be relatively uniformly heated, and melting of the steel sheet P due to concentration of heat may not occur.

As described above, according to the embodiments of the present disclosure, the steel sheet heating apparatus may prevent unwanted concentration of an electric current and may heat a desired area of a steel sheet.

Hereinabove, even though all of the components are coupled into one body or operate in a combined state in the description of the above-mentioned embodiments of the present disclosure, the present disclosure is not limited to these embodiments. That is, all of the components may operate in one or more selective combination within the range of the purpose of the present disclosure. It should be also understood that the terms of "include", "comprise" or "have" in the specification are "open type" expressions just to say that the corresponding components exist and, unless specifically described to the contrary, do not exclude but may include additional components. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A method of operating an apparatus for heating a steel sheet, wherein the apparatus comprises:

a positive electrode configured to make contact with a first electrode area of the steel sheet;

a negative electrode configured to make contact with a second electrode area of the steel sheet, wherein the first and second electrode areas are two areas adjacent to two respective edges parallel to a first direction among edges of the steel sheet; and a cooling member that includes a plurality of cooling blocks configured to make contact with cooling areas adjacent to third edges parallel to a second direction perpendicular to the first direction, the cooling member configured to radiate heat generated from the steel sheet, wherein the plurality of cooling blocks are disposed adjacent to opposite ends of the steel sheet with respect to the first direction, respectively;

wherein the apparatus is configured so that the heat is generated from the steel sheet by allowing an electric current to flow from the positive electrode to the negative electrode through the steel sheet; and wherein the positive electrode, the negative electrode, and the cooling member are arranged on the steel sheet such that a resistance of a path from the positive electrode to the negative electrode through the cooling areas is higher than a resistance of a path from the positive electrode to the negative electrode through a heating area;

the method comprising heating the heating area to a temperature above an Ac3 point among transformation points so as to be transformed to martensite after quenching, wherein the heating comprises applying a predetermined electric current to the steel sheet through the positive and negative electrodes.

2. The method of claim 1, wherein the positive and negative electrodes and the cooling member are arranged such that distal ends of the positive and negative electrodes adjacent to the cooling member with respect to the first direction are spaced apart from the cooling member along the first direction.

3. The method of claim 1, wherein a separation distance between cooling blocks facing each other, among the plurality of cooling blocks, with respect to the first direction remains constant along the second direction.

4. The method of claim 1, wherein coating layers are formed on contact side surfaces of the cooling blocks that make contact with the cooling areas, the coating layer comprising an electrically insulative material.

5. The method of claim 4, wherein the coating layers are formed of a ceramic material.

6. The method of claim 1, wherein the cooling blocks are formed of a material having a higher thermal conductivity than iron.

7. The method of claim 1, wherein the heating comprises heating a steel sheet having a rectangular parallelepiped shape.

8. The method of claim 1, wherein the apparatus is configured so that a resistance formed along the shortest path between the positive electrode and the negative electrode is formed to be smaller than the sum of a resistance formed along the shortest path between the cooling member and the positive electrode, a resistance formed along the shortest path between the cooling member and the negative electrode, and a resistance formed along a path from a point of the cooling member that is closest to the positive electrode to a point of the cooling member that is closest to the negative electrode.

9. The method of claim 1, wherein the cooling blocks are formed to make contact with upper surfaces or lower surfaces of the cooling areas.

10. The method of claim 1, wherein heating the heating area comprises elevating a temperature of the cooling areas to a temperature of 100° C. or less to prevent degradation of material properties.

11. The method of claim 1, wherein the positive and negative electrodes are located at the centers of the two respective edges parallel to the first direction with respect to the first direction.

12. The method of claim 1, wherein the positive electrode and the negative electrode are arranged to have line symmetry with respect to a straight line passing through the center of the steel sheet along the first direction.

13. The method of claim 1, wherein the shortest straight lines connecting the positive and negative electrodes and the cooling blocks are formed to be inclined with respect to the first direction and the second direction.

14. A method for heating a steel sheet having a plurality of edges, the method comprising:

contacting a first electrode area of the steel sheet with a positive electrode;

contacting a second electrode area of the steel sheet with a negative electrode, wherein the first and second electrode areas are, respectively, two areas adjacent to first and second edges parallel to a first direction;

contacting a cooling block of a cooling member with a cooling area of the steel sheet, the cooling area adjacent to a third edge parallel to a second direction that is perpendicular to the first direction; and heating the steel sheet by causing an electric current to flow through the steel sheet from the positive electrode to the negative electrode, the cooling block radiating a portion of the heat generated from the steel sheet so that the cooling area is elevated to a temperature of 100° C. or less when heating the steel sheet;

wherein the positive electrode, the negative electrode, and the cooling member are arranged on the steel sheet such that a resistance of a path from the positive electrode to the negative electrode through the cooling area is higher than a resistance of a path from the positive electrode to the negative electrode through the cooling member.

15. The method of claim 14, wherein a resistance formed along the shortest path between the positive electrode and the negative electrode is smaller than the sum of a resistance formed along the shortest path between the cooling member and the positive electrode, a resistance formed along the shortest path between the cooling member and the negative electrode, and a resistance formed along a path from a point of the cooling member that is closest to the positive electrode to a point of the cooling member that is closest to the negative electrode.

16. The method of claim 14, wherein heating the steel sheet comprises heating a heating area to a temperature above an Ac3 point among transformation points so that the heating area is transformed to martensite after quenching.

17. The method of claim 14, wherein contacting the cooling block of the cooling member comprises contacting a plurality of cooling blocks of the cooling member with respective cooling areas of the steel sheet.

18. A method of operating an apparatus for heating a steel sheet, the apparatus comprising a positive electrode configured to make contact with a first electrode area of the steel sheet, a negative electrode configured to make contact with a second electrode area of the steel sheet, wherein the first and second electrode areas are two areas adjacent to two respective edges parallel to a first direction among edges of the steel sheet, the apparatus further comprising a cooling member that includes a plurality of cooling blocks configured to make contact with cooling areas adjacent to third edges parallel to a second direction perpendicular to the first direction, the cooling member configured to radiate heat generated from the steel sheet, the plurality of cooling blocks being disposed adjacent to opposite ends of the steel sheet with respect to the first direction, respectively, the method comprising:

generating heat from the steel sheet by allowing an electric current to flow from the positive electrode to the negative electrode through the steel sheet while keeping the cooling areas to a temperature of 100° C. or less, wherein the positive electrode, the negative electrode, and the cooling member are arranged on the steel sheet such that a resistance of a path from the positive electrode to the negative electrode through the cooling areas is higher than a resistance of a path from the positive electrode to the negative electrode through a heating area.

19. The method of claim 18, wherein generating heat from the steel sheet comprises heating a steel sheet having a rectangular parallelepiped shape.

* * * * *